US005161709A

United States Patent [19]

Oestreich, Jr.

[11] Patent Number: 5,161,709

[45] Date of Patent: Nov. 10, 1992

[54] HINGED COLLAPSIBLE CONTAINER

[75] Inventor: Gerald F. Oestreich, Jr., Burnsville, Minn.

[73] Assignee: World Container Corporation, Burnsville, Minn.

[21] Appl. No.: 622,339

[22] Filed: Nov. 29, 1990

Related U.S. Application Data

[63] Continuation of Ser. No. 303,553, Jan. 30, 1989, abandoned.

[51] Int. Cl.[5] ..... B65D 27/00

[52] U.S. Cl. ..... 220/6; 220/1.5; 220/4.28

[58] Field of Search ..... 220/1.5, 4–28, 220/6

[56] References Cited

U.S. PATENT DOCUMENTS

| | | | |
|---|---|---|---|
| 1,114,321 | 10/1914 | Warne . | |
| 1,355,213 | 10/1920 | Chipperfield . | |
| 1,991,965 | 2/1935 | Steinbreder | 220/76 |
| 2,202,675 | 5/1940 | Sherts | 206/2 |
| 2,666,552 | 1/1954 | Coit, Jr. | 220/97 |
| 2,756,894 | 7/1956 | Phillips | 220/6 |
| 2,952,379 | 9/1960 | Potter | 220/6 |
| 2,978,136 | 4/1961 | Ehrenfreund | 220/9 |
| 3,040,925 | 6/1962 | Mills | 220/1.5 |
| 3,288,319 | 11/1966 | Cahill | 217/12 |
| 3,315,800 | 4/1967 | Wagner | 206/46 |
| 3,332,319 | 7/1967 | Gerry | 88/28 |
| 3,349,939 | 10/1967 | Averill | 220/6 |
| 3,374,915 | 3/1968 | Verhein et al. | 220/4 |
| 3,386,218 | 6/1968 | Scott | 52/309 |
| 3,397,496 | 8/1968 | Sohns | 52/286 |
| 3,563,403 | 2/1971 | Luisada | 220/1.5 |
| 3,575,312 | 4/1971 | Luisada | 220/1.5 |
| 3,589,548 | 6/1971 | Weiss | 220/4 F |
| 3,628,683 | 12/1971 | Friedrich | 220/6 |
| 3,655,087 | 4/1972 | Luisada | 220/1.5 |
| 3,765,556 | 10/1973 | Baer | 220/1.5 |
| 3,797,691 | 3/1974 | Williams, Jr. | 220/1.5 |
| 3,853,238 | 12/1974 | Luisada et al | 220/1.5 |
| 3,870,185 | 3/1975 | Sanders et al. | 220/6 |
| 3,874,546 | 4/1975 | Sanders et al. | 220/6 |
| 3,940,007 | 2/1976 | Griffiths | 220/4 F |
| 3,955,703 | 5/1976 | Zebarth | 220/6 |
| 3,964,636 | 6/1976 | Rehrig | 220/306 |
| 3,974,616 | 8/1976 | Beckley | 52/738 |
| 3,985,258 | 10/1976 | Quigley et al. | 220/4 F |
| 3,998,327 | 12/1976 | Box | 206/500 |
| 3,999,676 | 12/1976 | Trebilcock | 220/6 |
| 4,000,827 | 1/1977 | Emery | 220/4 F |
| 4,005,795 | 2/1977 | Mikkelsen | 220/7 |
| 4,020,967 | 5/1977 | Hammond | 220/6 |
| 4,044,910 | 8/1977 | Box | 220/7 |
| 4,050,604 | 9/1977 | Flanders | 220/4 F |
| 4,081,099 | 3/1978 | Shead | 220/6 |
| 4,099,640 | 7/1978 | Nessfield et al. | 220/6 |
| 4,120,551 | 10/1978 | Godtschalck | 312/330 R |

(List continued on next page.)

*Primary Examiner*—Steven M. Pollard

*Attorney, Agent, or Firm*—Robert A. Elwell; Harold D. Jastram

[57] ABSTRACT

A hinged collapsible container having a rigid construction including a base and upstanding hinged sides connected to a base having a generally flat supporting surface with a plurality of legs with mortises arranged to extend downward from the planar base support surface to receive and secure tenons attached to upstanding hinged sides. The plurality of legs are spaced about the periphery of the base and are adapted to be easily supported by a forklift. Upstanding hinged sides with tenons inserted into mortise elements of the unit are held in substantially erect position with the edges of the upstanding sides having a lap joint corner construction. Two of the sides are provided with latches at the edges to lock the upstanding sides together. The upstanding sides are hinged above the tenons to permit the hinged sides to be folded on the base. An access gate in at least one side is hinged and latched to the side and is locked in place by a boss and cavity lock.

18 Claims, 13 Drawing Sheets

U.S. PATENT DOCUMENTS

| | | | |
|---|---|---|---|
| 4,162,737 | 7/1979 | Clive-Smith | 220/1.5 |
| 4,170,313 | 10/1979 | Caves et al. | 220/7 |
| 4,171,059 | 10/1979 | Heller | 220/4 F |
| 4,186,841 | 2/1980 | Buckley et al. | 220/6 |
| 4,214,669 | 7/1980 | McQuiston | 220/6 |
| 4,240,555 | 12/1980 | Jurasek | 206/511 |
| 4,320,845 | 3/1982 | Waller | 220/6 |
| 4,376,593 | 3/1983 | Schaefer | 403/231 |
| 4,503,973 | 3/1985 | Andersson | 206/386 |
| 4,506,798 | 3/1985 | Goutille | 220/1.5 |
| 4,643,314 | 2/1987 | Kidd | 206/600 |
| 4,673,087 | 6/1987 | Webb | 206/600 |
| 4,674,647 | 6/1987 | Gyenge et al. | 220/6 |
| 4,693,386 | 9/1987 | Hughes et al. | 200/6 X |
| 4,735,331 | 4/1988 | Keenan et al. | 220/6 |
| 4,775,068 | 10/1988 | Reiland et al. | 220/6 |
| 4,785,957 | 11/1988 | Beck et al. | 220/4 F |
| 4,809,851 | 3/1989 | Oestreich et al. | 220/4 F X |
| 4,834,254 | 5/1989 | Mead | 220/6 |
| 4,917,255 | 4/1990 | Foy et al. | 220/4 F |

HINGED COLLAPSIBLE CONTAINER

This is a continuation of prior application Ser. No. 07/303,553, filed Jan. 30, 1989, now abandoned.

BACKGROUND OF THE INVENTION

Effective methods of supplying large and small components to a manufacturing plant on a timely and efficient basis enhances modern mass production processes. These same manufacturing processes and procedures also generate a large quantity of refuse and industrial waste which need to be removed from the manufacturing site to proper waste disposal locations or to recycling plants. These components supply and waste removal needs create a requirement for effective means for timely and constant delivery to manufacturing sites of a variety of industrial components and products. Without the timely arrival and a continuous supply of such components, mass production of finished goods rapidly encounters troublesome and inefficient production delays.

Examples of recyclable waste components might include plastic containers used for encapsulating or transporting fragile electronics components which are used in manufacture of larger electrical units. The plastic containers or carriers for these components are essentially waste products which in many cases can be reprocessed for additional or continuous use. Accumulation of these waste components create a problem for the manufacturer and requires special handling of the components and timely and continuous removal from the manufacturing site in order to avoid unmanageable build-up of waste at the manufacturing site.

Supply of components to manufacturing plants and removal of both finished goods and waste products from the manufacturing plant have been solved in a variety of ways. In some cases entire railroad cars or trucks are parked at the manufacturing site for the purpose of acting as temporary storage. These railroad cars and tractor trailers are extremely expensive components to have idly parked. The extreme cost competitiveness involved in mass production prohibits the use of expensive containers of this type. Such transportation trailers and cars are also prohibitively expensive for collecting finished product or waste product for the same reason.

Other methods of delivering components to manufacturing plants and for removing finished goods and waste products involve some form of container which can be delivered to the manufacturing plant and which is essentially a single-use container. Examples of these single-use containers might include containers made of various types of compressed paper. Other such containers include reinforced paper containers or wooden crates. Combinations of wood and paper-type fabric also are frequently used for transporting components for manufacturing processes. Most of these wood or paper containers are destroyed or unsuitable for repeated use. Accordingly, these containers are the source of additional manufacturing waste products.

Many of the paper and wood containers are sufficiently large and laden with materials which are sufficiently heavy so that they present handling problems at the plant. These handling problems at the plant have typically been solved by the use of wooden pallets. Wood and fabric containers or other rigid containers containing heavy materials are frequently stacked on wooden pallets which have been constructed so that a forklift may be used to engage the pallet and lift the pallet and container filled with components to a location where further disposition may be made of the contents of the container.

These wooden containers and the pallets themselves become waste materials and are frequently damaged in the process of handling the heavy containers. The pallets are made from inexpensive wood with the view that the pallets will be damaged beyond use after a limited number of usages. Consequently, these pallets become additional waste material for a manufacturer.

Large containers which have been successfully used in manufacturing processes and in waste disposal procedures and which are intended for repeated use are frequently extremely large containers of sturdy construction. Many waste disposal containers, as an example, are made from thick rolled steel plates which permit rough handling of the container without destruction. These containers are as high as six feet tall and as large as six feet square or larger. Frequently, these sturdy large containers are also the same containers or similar to containers used for shipping components to manufacturers for use.

Typical uses of these large containers might be involved in the supply to an electrical units manufacturer where large numbers of transistors, resistors, capacitors and other small parts are used by the manufacturer to assemble radios, televisions and similar electronic components. Resistors, as an example, might be shipped to the manufacturer in bulk in such containers and deposited at the manufacturers warehouse for use in the manufacturing process.

The automobile industry also has a high demand for supplies of nuts, bolts, washers and similar connecting devices. Frequently, these connectors are purchased in bulk from suppliers of such units. The bulk supplies are shipped from the manufacturer to the auto producer in containers which are deposited at the manufacturing warehouse or at the input line of the auto assembler.

Other industries also use bulk supplies of products. An example in the plastics industry might include plastic pellets which are supplied to a plastic molding manufacturer. Plastic pellets having the physical characteristics required by the manufacturer of plastic parts are supplied in bulk in large containers from which the raw plastic pellets are removed and further processed in the manufacturing process.

Likewise, bulk delivery of food products or components for food products such as flour, seasonings and similar food ingredients frequently need to be delivered to processors of packaged food products for mixing with a variety of components to produce packaged or finished food products.

As product is removed from the bulk containers by the manufacturer, the containers either become waste product themselves or if they are of the sturdy steel-plate construction or similar construction, they become empty units which must be stored until reuse. Whether the result of the manufacturing process is generation of a large volume of waste product from the containers themselves or the presence at the manufacturing site of a large volume of empty containers, there, nevertheless, is created for the manufacturer a handling problem and storage cost. Any reusable containers must be handled and stored until the container can be reused. These handling costs and storage costs all add incremental costs to the cost of manufacturing the end product and, therefore, removal of these cost components from the cost of manufacturing is very desirable on the part of manufacturers.

Additional problems encountered by goods transportation industries might be illustrated by the movement of household and industrial goods by transportation companies. Frequently, household goods or business goods might be packed in containers for loading on larger trucks. These containers are essentially one-way shipping units which must then be transported in an empty condition back to another site for filling with additional household goods. It is important to such transportation companies that the trucks hauling empty containers haul as many such containers as possible. Therefore, an effective and efficient collapsible container will permit such transportation companies to effectively and efficiently haul large numbers of these collapsible type containers to sites where they can be assembled for reuse. Likewise, storage of containers awaiting use can present costly warehousing if the containers cannot be collapsed to as small a unit as possible.

There is substantial incentive for providing a container which avoids many of these problems.

SUMMARY OF THE INVENTION

An object of the present invention is to provide a collapsible container having hinged upstanding sides to establish a generally rectangular or square upstanding unit which includes a plane or base having a plurality of legs arranged to support the unit.

A further object of the present invention is to provide a container formed of joinable and separable sections including four hinged sides which are provided with latch elements and lap joint connections at engaging edges of the sides.

Another object of the invention is to provide a knockdown container having four releasable and joinable sides formed with a plurality of vertically oriented strengthening columns to provide columnar strength to the unit to permit stacking of multiple like containers.

It is still a further object of the present invention to provide a knockdown container for storage and transportation of various bulk materials which includes a base having a plurality of peripherally spaced legs with the spacing selected to permit forks of a fork lift truck or other material handling vehicle to be inserted beneath the base and between the legs for lifting the container and load.

A further object of the present invention is to provide a collapsible container which includes individual hinged sides connectable along the respective edges to form a generally rectangular container with selected sides being provided with corner locking elements that lock the individual sides together.

Another object of the present invention is to provide a collapsible container employing mortise joints for the purpose of connecting hinged sides of a container to a base unit where the sides are joined by lap joints and locks.

Another object of the present invention is to provide a collapsible container for the storage or transportation of various materials which includes four hinged side elements, each of which is connectable through the use of a mortise joint to a base unit and in which the mortise joint is formed as part of legs supporting the container and positioned to permit a lift fork vehicle to lift the container fully loaded for warehousing or positioning at a manufacturing line assembly.

A further object of the present invention is to provide an access gate in at least one side of a hinged collapsible container which permits access to the interior of the container and which is locked in place by a lock mechanism and a boss and cavity restraining means.

These and other objects and advantages of the invention will more fully appear from a consideration of the accompanying drawings and disclosure.

DESCRIPTION OF PREFERRED EMBODIMENT

Figure 1:
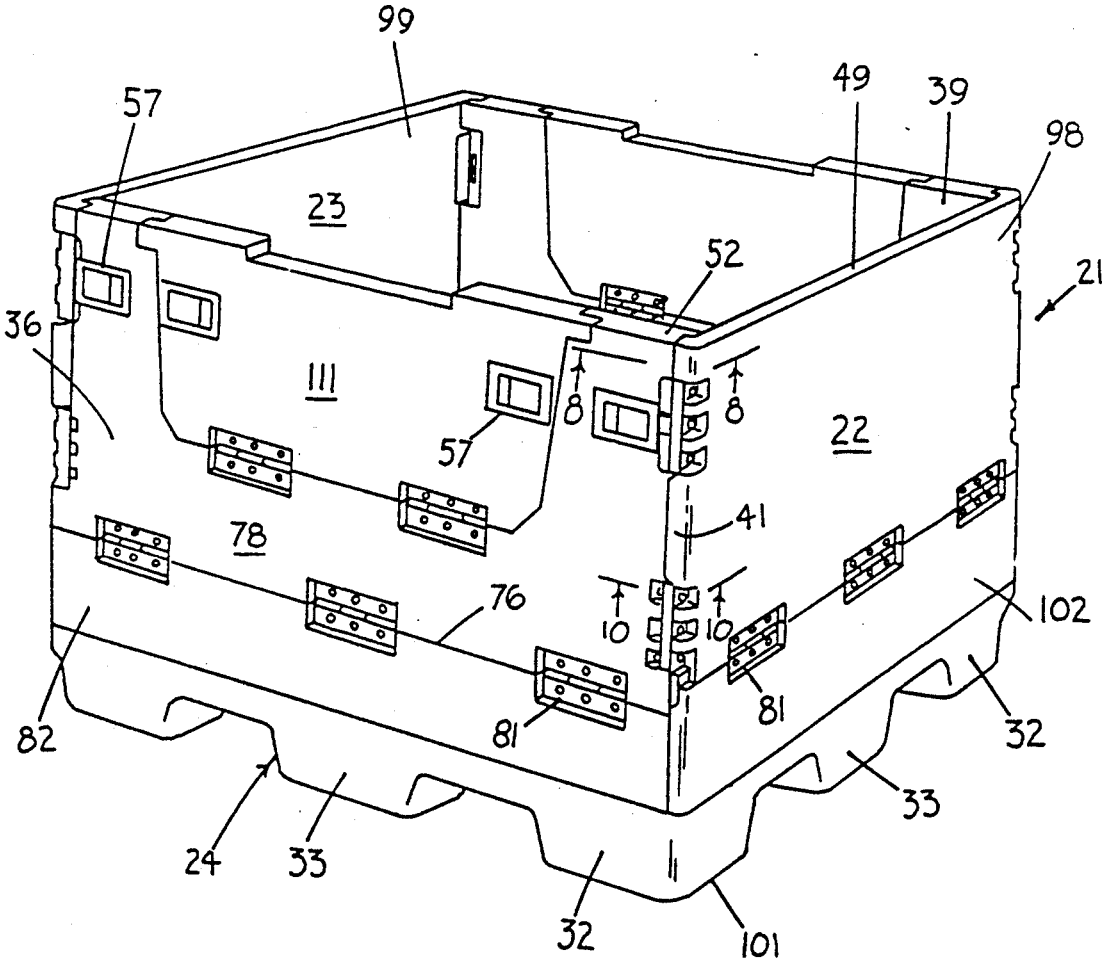
FIG. 1 is a perspective view of a hinged collapsible container constructed and assembled in accordance with the present invention.

Refer first to FIG. 1 of the drawings. FIG. 1 of the drawings illustrates a hinged collapsible container generally designated by the numeral 21 in accordance with the present invention. The collapsible container 21 also contains hinged sides 22 and 23. These hinged sides are illustrated being assembled to a base 24 in FIGS. 2, 3 and 4 of the drawings. The container 21 made according to the present invention can be of a variety of sizes. The unique features of the invention permit the container to be relatively large in size. For instance, the container 21 can easily be eight feet square and five feet high or larger when finally assembled. The base 24 may be either rectangular or square in shape as might be necessary to meet the particular shipping needs of the shipper using the container or of the manufacturer using the container as a storage unit. Consequently, the sides of the container are quite large, but, nevertheless, can be assembled by a single person due to the mortise joint features utilized in the construction of the container 21.

Figure 2:
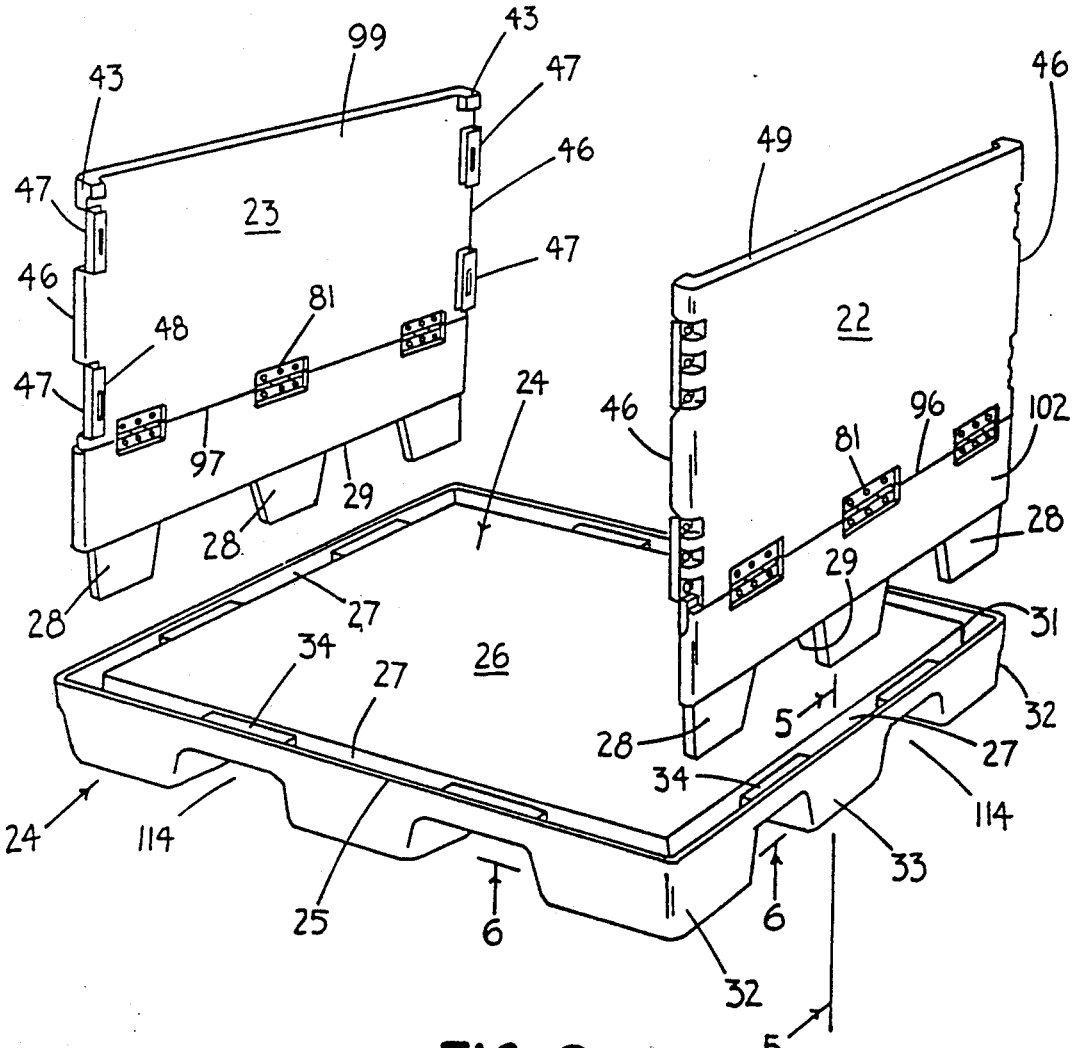
FIG. 2 is a partially exploded perspective view of a container according to the present invention showing two sides in the process of assembly on a base.

The base 24 of the container 21 includes a planar support surface or platform 26. This surface is best illustrated in FIG. 2 of the drawings where it is illustrated together with end or hinged sides 22 and 23 positioned over an end edge or channel 27 of the base 24. Each of the end sides 22 and 23 have a tenon 28 extending from a bottom edge 29 of the end side 22. Since end sides 22 and 23 are identical, the function and cooperation of features will be described in connection with only one such side. The other side is deemed to function the same as the one described. As the end side 22 is lowered by someone assembling the container 21, the tenons 28 engage a mortise 31 formed in corner legs 32 and center legs 33 of the base 24. The result is a mortise joint which is sufficiently strong to support the side 22 in the base 24 without additional mechanical support.

The entire bottom edge 29 of the end side 22 fits within channel 27 so that the bottom edge is in contact with support surface 34 in channel 27. Support surface 34 is a surface between the legs around the periphery 25 of the base 24. It will then be apparent that tenons 28 engage matching mortises 31 to provide an extremely durable and stable mortise and tenon joint which will support end 22 in the assembled container. The bottom edge 29 rests on the support surface 34.

Figure 5:
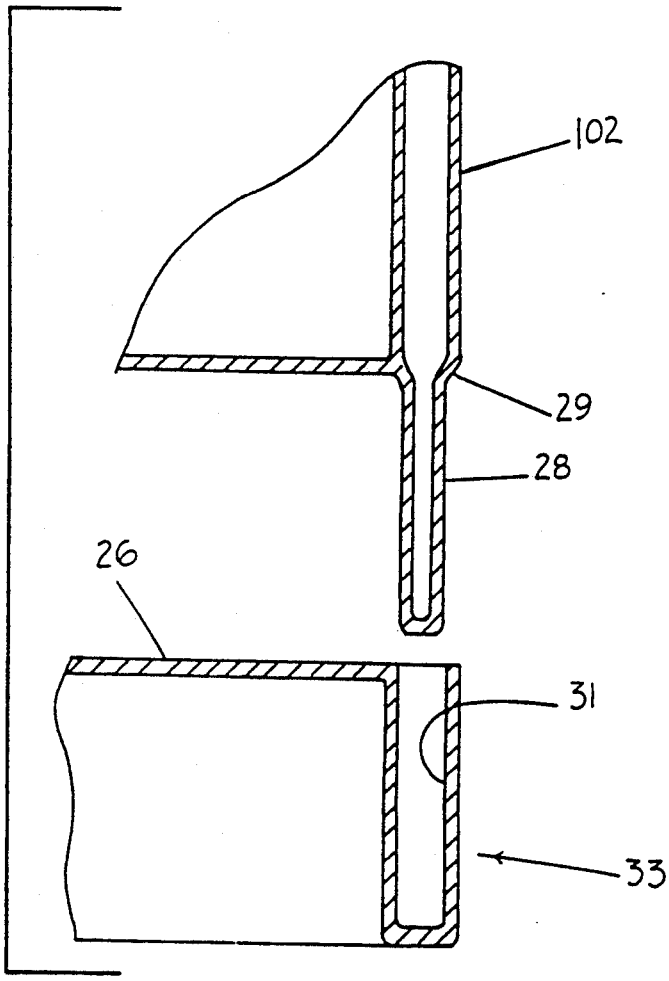
FIG. 5 is a cross-sectional view taken along line 5—5 of FIG. 2 of the drawings and illustrating a mortise joint arrangement.
Figure 6:
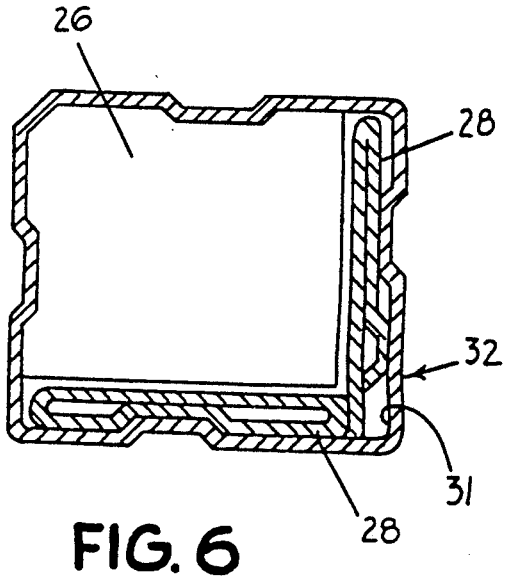
FIG. 6 of the drawings is a cross-sectional view of a leg portion of a base taken along line 6—6 of FIG. 2 of the drawings.

A more complete understanding of the mortise and tenon joint can be obtained by reference to FIGS. 5 and 6 of the drawings in which a tenon 28 is positioned over a mortise 31. The tenon 28 will be inserted into the mortise 31 to form the mortise and tenon joint which is characteristic of the container 21. FIG. 5 illustrates the mortise joint taken through a center leg 33 where the leg 33 is shown in cross-section. FIG. 6 is a cross-sectional view taken along line 6—6 of FIG. 2 and illustrates the tenons 28 in cross-section and inserted into the mortise 31 of the end leg 32. Note that the end leg 32 contains two mortises 31. The leg 32 as well as leg 33 extend downwardly from the support surface 26 and perpendicular to the support surface 26. Therefore, it will be apparent that the mortise 31 is also perpendicular to the support surface 26. One tenon 28 extends from edge 28 of end side 22 whereas the other tenon 28 extends from a gate side 36 which is illustrated in FIG. 3 of the drawings.

After end sides 22 are lowered vertically as illustrated in FIG. 2 of the drawings into engagement with the base 24, and the tenons 28 are securely engaged in the mortises 31 of the center legs 33 and corner legs 32, the identical side 22 and 23 are then in a free-standing position and further assembly of the container is now possible. Further assembly of the container 21 is illustrated in FIG. 3 of the drawings. The container 21 contains a gate side 36 which is then lowered into engagement with the base 24 just as end side 22 was lowered into engagement with the base 24. Gate side 36 also is constructed virtually identical to the end side 22 in the sense that tenons 37 are employed to engage mortises which are located in end legs 32 and center legs 33. As will be observed from FIGS. 2 and 3 of the drawings, channel 27 extends entirely around the periphery 25 of the base 24 and provides a channel into which bottom edge 29 of end side 22 and bottom edge 38 of gate side 36 can be positioned when the gate side 36 is fully engaged with the base 24.

Figure 3:
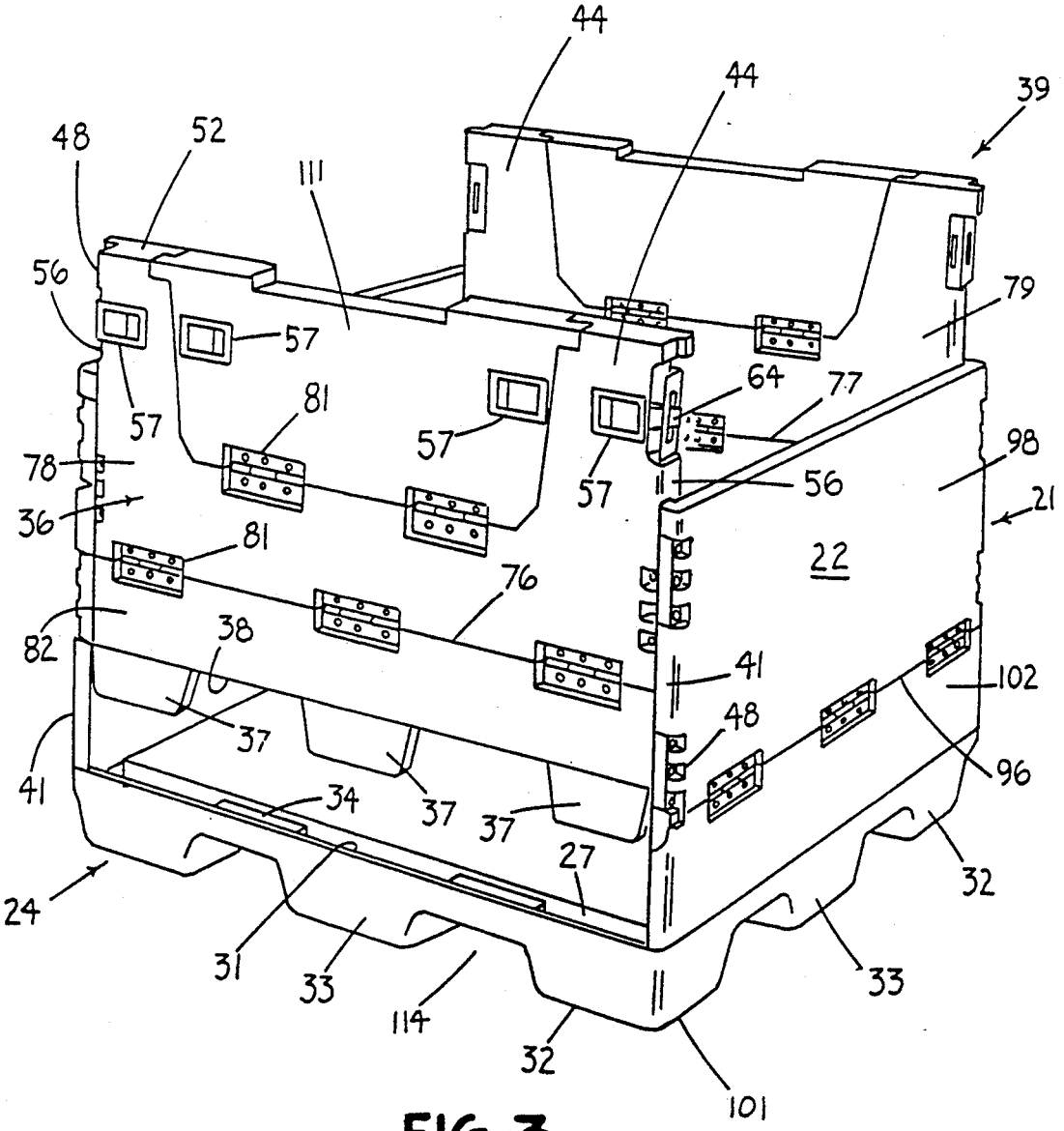
FIG. 3 is a partially exploded perspective view of a hinged collapsible container according to the present invention showing a pair of sides assembled on a base with a second set of sides partially in position for assembly on the base.

The gate side 36 is illustrated in FIG. 3 in the partially engaged position with the tenons 37 positioned over the mortises 31 which are located in the legs 32 and 33. With the bottom edge 38 thoroughly engaged with the channel 27, the assembled container will then look like FIG. 1 of the drawings. Bottom edges 29 and 38, when assembled, lie in a common plane parallel to the planar support surface 26 of base 24. A side opposite gate side 36 could be identical to gate side 36 or it could be the same as end sides 22. In the drawings of the present invention, the gate side 36 is illustrated to be identical to another gate side 39. These gate sides have a gate feature which will be described hereinafter.

As with end sides 22, once gate sides 36 and 39 are lowered into position to bring tenons 37 into engagement with mortise 31, a mortise joint is formed which is sufficiently strong to support gate sides 36 and 39 on the base 24.

Frequently, the containers 21 are filled with extremely heavy parts. Parts might include small screws or washers which provide some of the characteristics of a fluid when the small parts are deposited in large quantities in relatively large containers. When the container or any container is filled with such parts, there is a force exerted on the sides of the container which is like that which is exerted by fluid on the sides of a container enclosing the fluid. Consequently, such small parts will tend to force the walls of the container 21 outwardly. If some provision is not made for supporting the walls of the container 21, then this outward force will ultimately result in a destruction of the container as the sides of the container are forced apart. These containers 21 can also be used for storing fluids if a liner is used in the container.

Figure 7:
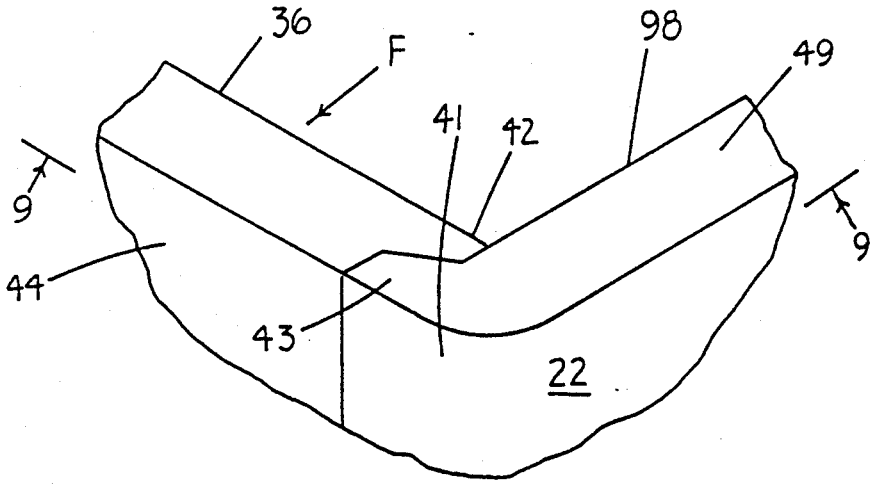
FIG. 7 is a fractional perspective view of a corner of a container showing a lap joint.
Figure 8:
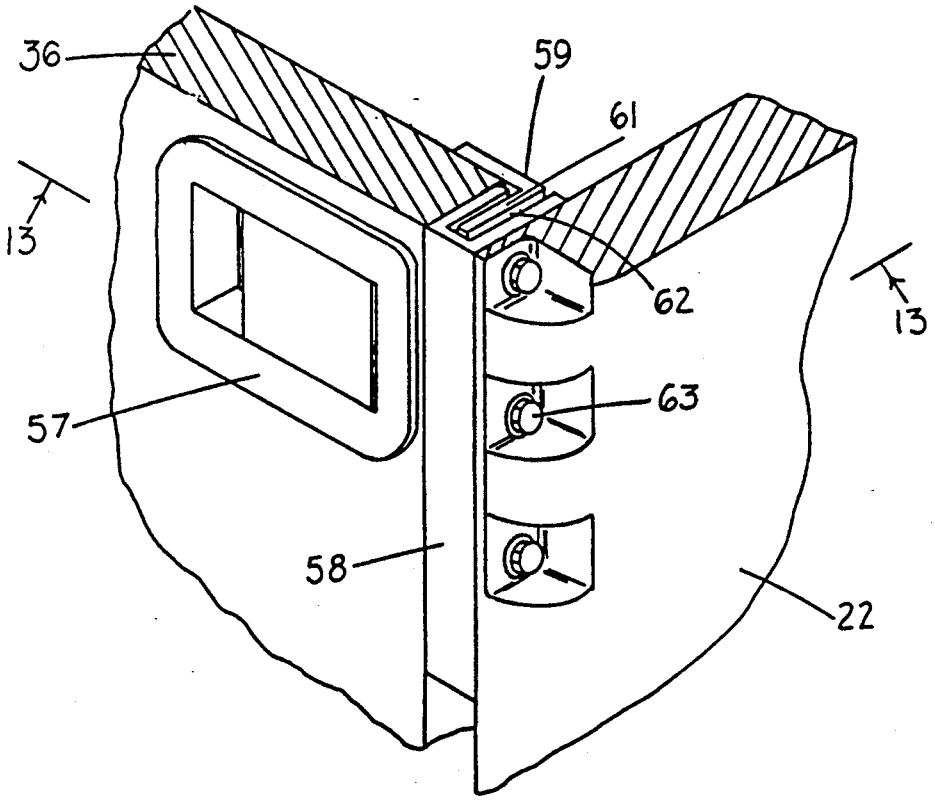
FIG. 8 is a fractional, cross-sectional perspective view taken along line 8—8 of FIG. 1 of the drawings illustrating a latch mechanism and lap joint.

Reference to FIG. 3 of the drawings will reveal that end sides 22 and gate sides 36 have features for preventing the sides from being forced apart when the container is assembled. The corners 41 of the container 21 are formed by a lap joint of the type illustrated in FIGS. 7, 8 and 9 of the drawings. Reference to FIG. 7 of the drawings will reveal that corner 41 is formed by a lap joint 41 having a tongue 42 which engages a lip 43 to provide a secure corner 41 at the juncture of sides 22 and 36 of the container. All four corners of the container 21 are formed by lap joints 41 of the same construction as described in connection with FIGS. 7 and 8.

When force F as illustrated in FIG. 7 of the drawing is exerted on gate side 36, the force of the liquid or small parts on the container will tend to force the gate side 36 in the arrow direction F as illustrated in FIG. 7. When this force is exerted, tongue 42 which forms a part of the support side 44 of gate side 36 engages lip 43. Lip 43 is a part of end side 22 and, consequently, the tongue 42 will engage up 43 with increasing pressure as the force F increases along the arrow direction.

Figure 9:
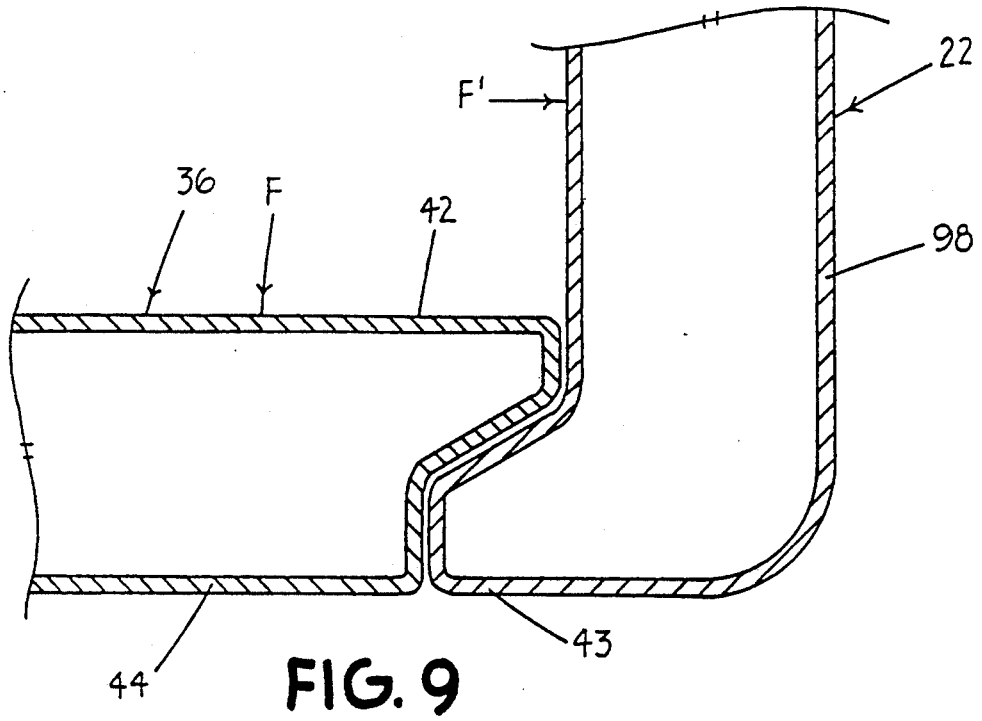
FIG. 9 is a fractional cross-sectional view taken along line 9—9 of FIG. 7 of the drawings and showing a lap joint of a corner of a container in accordance with the present invention.

This force relationship can also be observed in FIG. 9 of the drawings where the force F again is shown in the arrow direction on gate side 36 to force the tongue 42 into engagement with lip 43 of side 22.

Thus, it will be apparent from reference to FIG. 1 of the drawings that as internal forces created by material in the container 21 force gate sides 36 and 39 apart or outwardly, the tongues 42 which are identical on each edge of the gate sides 36 will engage corresponding lips 43 formed on each edge of the end sides 22.

The lips 43 are located along substantially the entire length of upright edge 46 of each of the end sides 22 as illustrated in FIG. 2 of the drawings except in those areas where catches 47 are located. It will be observed in FIG. 2 of the drawings that the lip 43 extends along the entire length of edges 46 to engage corresponding tongues 42 which are likewise molded into the edge 48 (FIG. 3) of gate sides 36 and 39 in order to form a lap joint corner 41 adapted to prevent the sides 36 and 37 from being forced outwardly by the pressure generated from material within the container 21. The tongue and lip joint or lap joint which is formed by the tongue 42 and lip 43 extend along the entire upright engaging edges of the sides 22, 23, 36 and 39, respectively, except in those areas where catches 47 and each locking mechanism 57 are positioned on the sides. It should also be noted that the particular configuration of tongue 42 and lip 43 requires that gate side 36 be collapsed inward toward the center of support surface 26 before end wall 22 can be collapsed. This insures that the container 21 is collapsed the same each time it is collapsed for storage.

Figure 10:
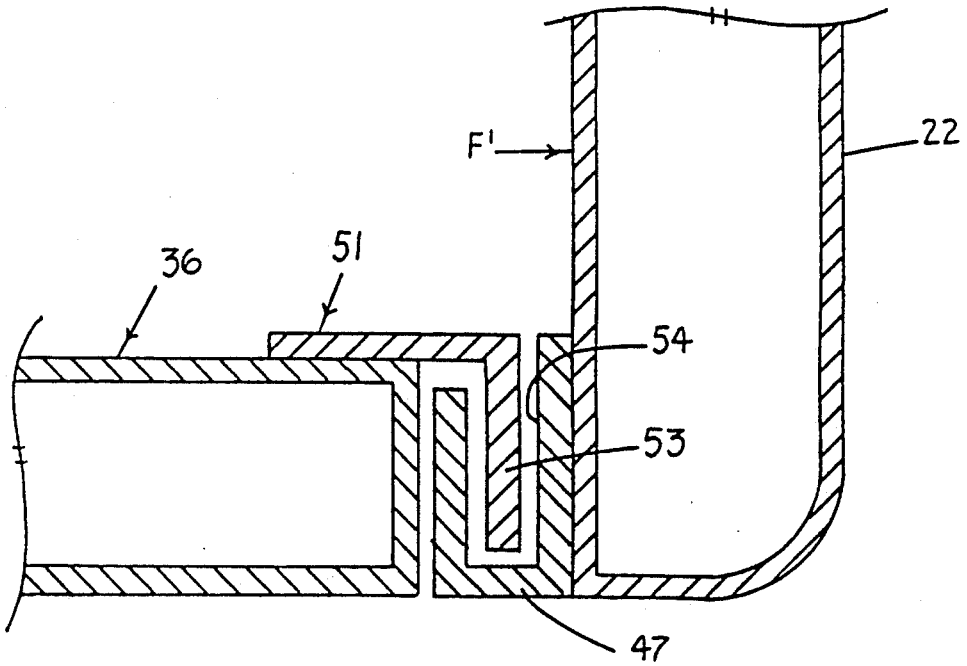
FIG. 10 is a fractional cross-sectional view taken along line 10—10 of FIG. 1 of the drawings showing a restraining member interconnecting sides of a container.
Figure 11:
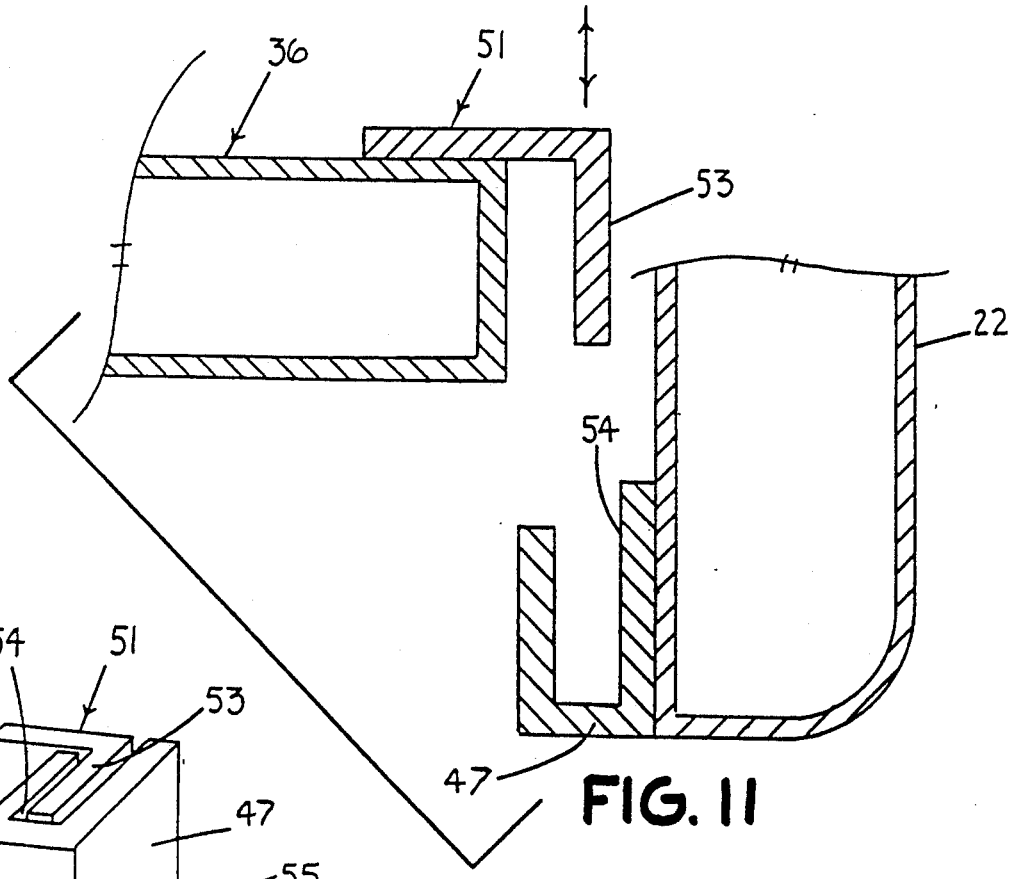
FIG. 11 is a fractional cross-sectional view as illustrated in FIG. 10 of the drawings with the parts disassembled or exploded.

In order to prevent force F' from moving end side 22 in the direction F' as illustrated in FIG. 9 of the drawings, and thus force end sides 22 away from engagement with gate sides 36 and 39, a restraining system must be utilized to add structural stability to the container 21. This structural stability is provided in two ways. First, a retainer 55 is provided along corner or upright edge 41 where the end side 22 and gate side 36 form corner 41. These retainers 55 are located on end side 22 and gate side 36 at a location intermediate the bottom edge 29 and the top edge 49 of the end side 22. The retainers interconnect the upper portions 78 and 98 of the end side 22 and gate side 36. Gate side 36 has a tongue stop 51 mounted between bottom edge 38 and top edge 52 and at a location so that a stop 51 will engage the catch 47 of end side 22. Catch 47 is a length of steel or other strong material having a generally U-shaped cross-section as illustrated in FIGS. 10 and 11 which is adapted to be engaged by the tongue 53 of stop 51. Stop 51 could be a section of 90' angle iron or similar metal or plastic material sufficiently strong to lock end side 22 to gate side 36 at corner 41.

Figure 12:
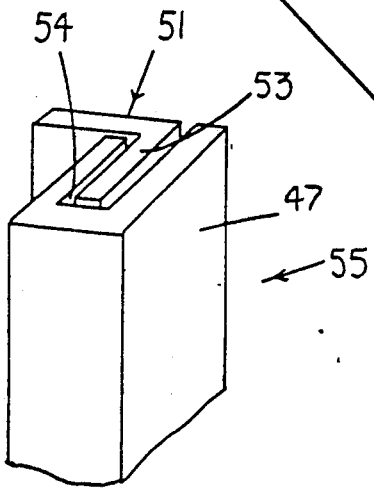
FIG. 12 is a perspective view of a restraining member illustrated in cross-section in FIGS. 10 and 11 of the drawings.

FIG. 12 shows the parts of retainer 55 in engagement with tongue 53 engaged within channel 54 of catch 47.

Figure 4:
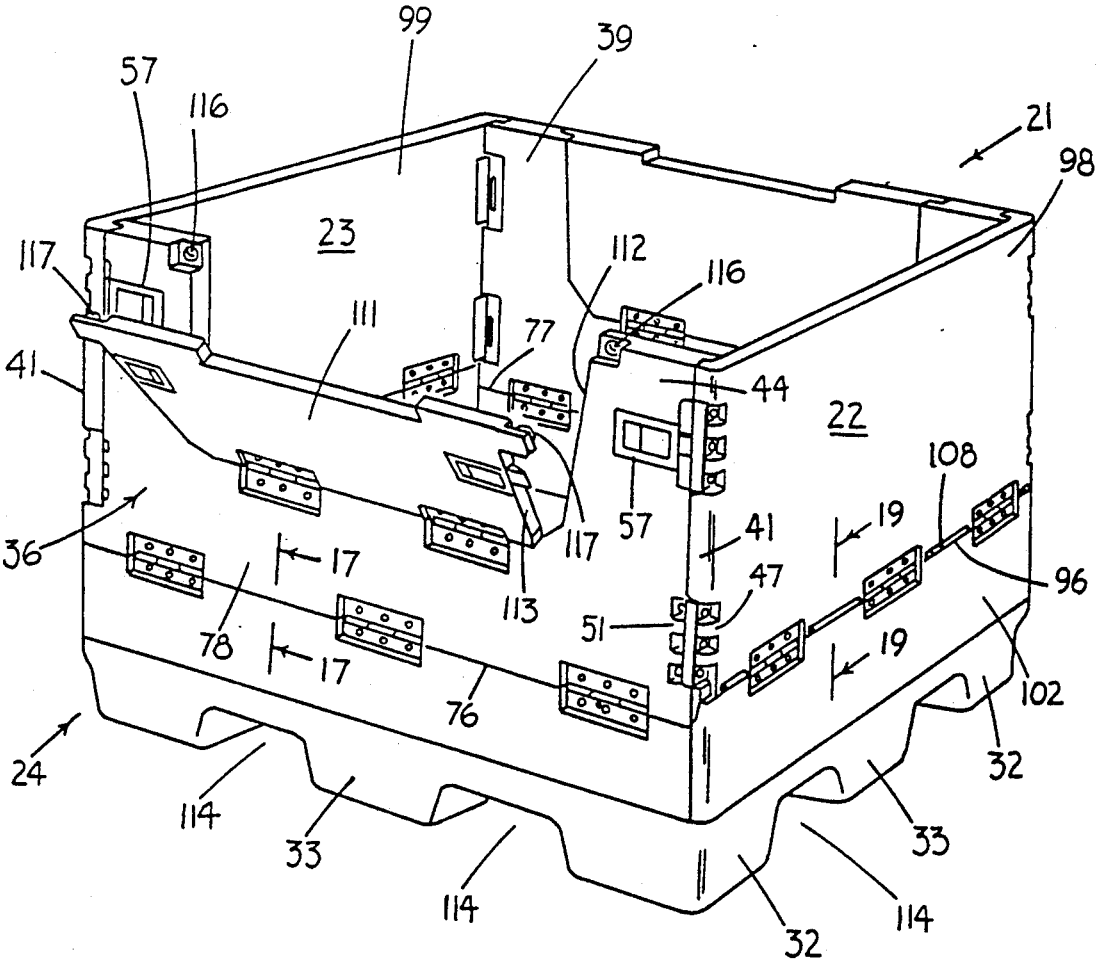
FIG. 4 is a fully assembled perspective view of a container of the type illustrated in FIG. 1 of the drawings showing a gate member partially opened.

Stop 51 is mounted with bolts or rivets as illustrated in FIG. 4 of the drawings on gate side 36 of the container 21 and is adapted to engage catch 47 when gate side 36 is mounted on base 24. During the assembly process, the gate side 36 is out of engagement as illustrated in FIG. 11 of the drawings with the end side 22. It is noted that tongue 53 is not in engagement with channel 24 of the catch 47. When the gate side 36 is properly mounted, tongue 53 is moved into engagement with the channel 54 so that the stop 51 engages the channel 54 of catch 47 as illustrated in FIG. 10 of the drawings. Engagement is also illustrated in FIG. 12 of the drawings where catch 47 and stop 51 are shown in isometric view with the stop 51 in engagement with the channel 54 of catch 47.

When the stops 51 which are mounted on the vertical or upright edges 56 of the gate side 36 are engaged with the catch 47 which are mounted on the edge 46 of the corresponding or adjacent end side 22, the cooperation of the stop 51 and catch 47 will prevent the gate side 36 and the end side 22 from being forced apart. This cooperation is best viewed in FIG. 10 of the drawings where it is illustrated that the catch 47 is engaged by the tongue 53 of the stop 51. When the tongue 53 thus engages the channel 54, the end side 22 is restrained by the tongue 53 from moving to the right as illustrated in FIG. 10 of the drawings. Thus, it will be apparent that tongue 53 prevents the end side 22 from being moved away from the gate side 36 and effectively locks the two sides together. As was noted in connection with a description of the lap joint involving lip 43 and tongue 42, this engagement of tongue 53 in channel 54 provides stability to the end side 22 and gate side 36 when the container 21 is filled with material. When a force F' is directed against the inside of end side 22, as illustrated in FIG. 10 of the drawings by the arrow direction of force F', the tongue 53 which is locked in channel 54 will prevent the side 22 from moving in the arrow direction. A similar passive restraint and tongue restraint are provided on each corner of the juncture between the end side 22 and the gate sides 36 so that the sides are effectively locked together and will not come apart as fluid or similar forces are applied to the inside surfaces of the end side 22 and the gate side 36. All of the corners 41 of the container 21 have at least one such catch 47. More than one such restraint may be used.

Figure 13:
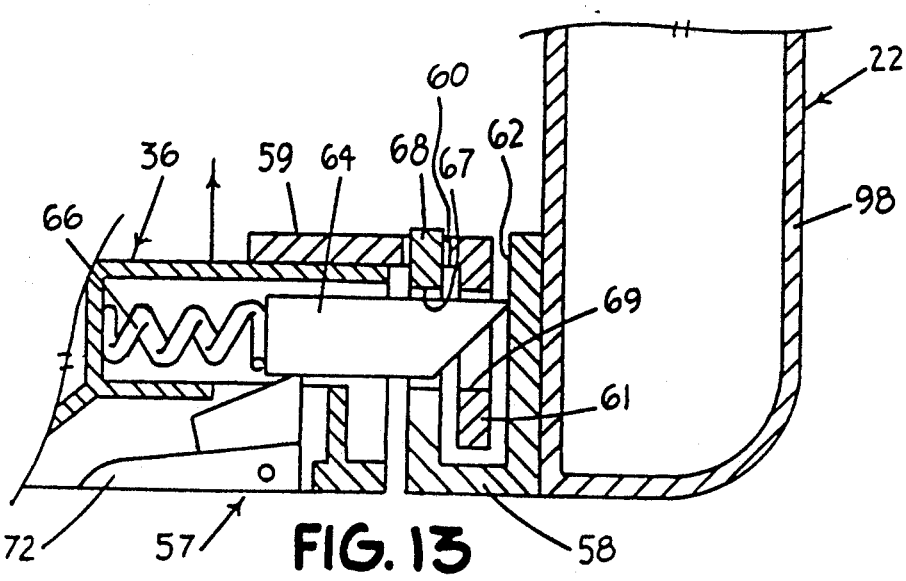
FIG. 13 is a fractional cross-sectional view taken along line 13—13 of FIG. 8 and illustrating a latching mechanism connecting two sides of a container in accordance with the present invention.

A latch and lock are also provided to connect the end sides 22 and gate side 36 together at a location nearer the top edges 49 and 52 of the end side 22 and gate side 36, respectively. This latch mechanism is generally referred to by numeral 57. There is a latch mechanism 57 provided on both vertical edges of the gate side 36 which engages a strike plate 58 which is almost the same as catch 47. The latch mechanism 57 is mounted in gate side 36. Part of the latch mechanism 57 includes a stop 59 which functions exactly the same as stop 51. Stop member 59 has a tongue 61 which engages a channel 62 of strike plate 58. Plate 58 may be bolted or riveted to side 22 by bolts 63 which extend through the wall material of end side 22 and into the plate 58 to securely connect the plate 58 to end side 22. A better understanding of the function of latch mechanism 57 can be realized from a reference to FIGS. 13, 14 and 15 of the drawings. FIG. 13 of the drawings shows the latch mechanism 57 fully in place and locked and preventing the end gate side 36 from moving in the arrow direction as illustrated in FIG. 13. A latch or bolt 64 is forced by spring 66 to the right as illustrated in FIG. 13 through an opening 67 in leg 68 of plate 58. The latch 64 extends further through an opening 69 in tongue 61 so that the tongue 61 of stop 59 is secured and locked to the leg 68 of plate 58. In this position, the latch mechanism 57 prevents the gate side 36 from moving in the arrow direction 50 and disengaging from the end side 22 of the container 21. Leg 68 also extends through an opening 60 so that the latch 64 provides additional restraint to prevent end side 22 from disengaging gate side 36.

Figure 14:
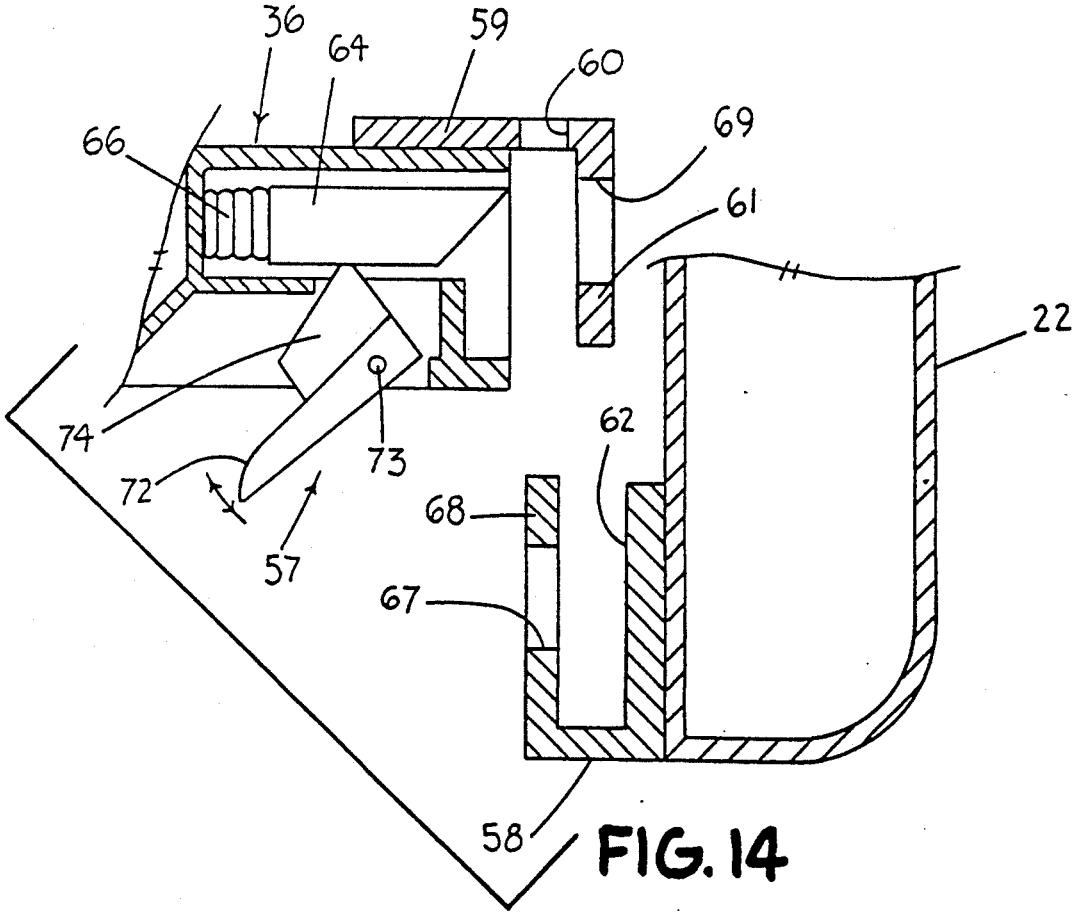
FIG. 14 is a fractional cross-sectional view as illustrated in FIG. 13 of the drawings with a latch mechanism disengaging a U-shaped restraining member attached to one wall of the container.

Refer next to FIG. 14 of the drawings which illustrates the gate side 36 disengaged from the end side 22. The unlatched condition as illustrated in FIG. 14 of the drawings can be achieved by pulling lever 72 outwardly from the side of gate side 36. Lever 72 is operated by pivoting the lever about pin 73 so that a projection 74 engages bolt 64 to move the bolt 64 to the left against the spring 66 and, thereby, move the bolt 64 out of engagement with tongue 61 of angle member 59. In this position, the latch 57 can be disengaged from the plate 58 so that the gate side 36 moves inwardly to the interior of the container 21 as illustrated in FIG. 14. This operation of latch mechanism 57 would also occur when the container 21 is being assembled. The lever 72 can be operated (as an option) so that the gate side 36 can be moved downwardly into engagement with the passive restraint 58 during the assembly process.

Figure 15:
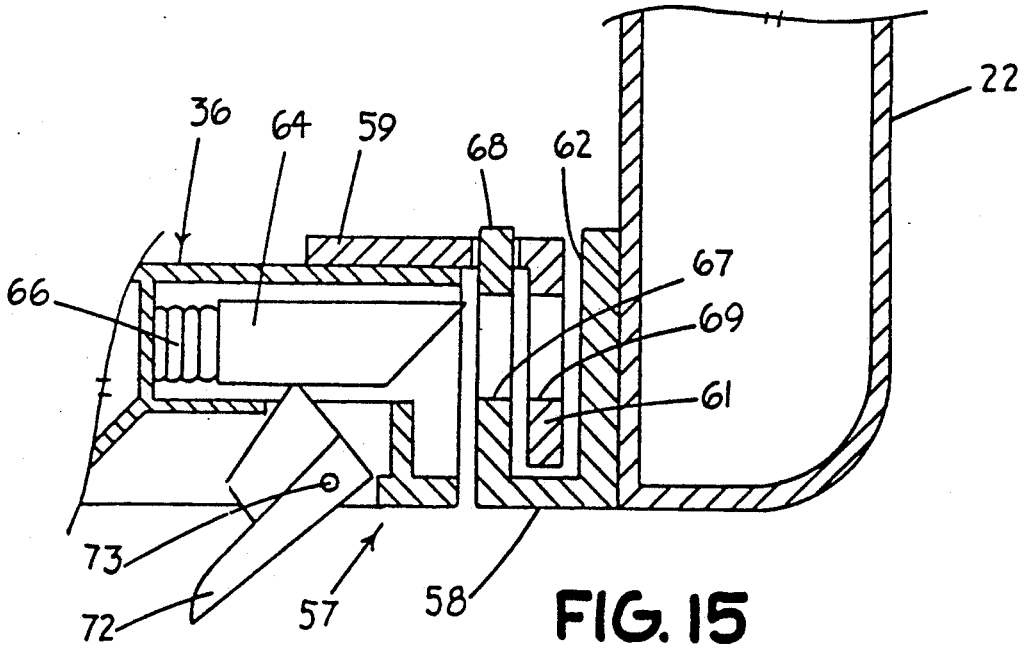
FIG. 15 of the drawings is a fractional cross-sectional view identical to FIG. 13 of the drawings showing a latching mechanism bolt in a disengaged position.

From the unassembled position illustrated in FIG. 14 of the drawings, the gate side 36 can be moved into engagement with the end side 22 so that the tongue 61 of stop 59 engages channel 62 of plate 58. It will be apparent that when bolt 64 remains in the retracted position as illustrated in FIG. 15 of the drawings, that the angle member 59 and the plate 58 function exactly the same as the catch feature described earlier in connection with catch 47. The cooperation of the stop 59 and the plate 58 will prevent the end side 22 from being moved in the arrow direction of FIG. 15 out of engagement with the gate side 36. This movement is prevented because the tongue 61 engages channel 62 of the plate 58 and prevents end side 22 from disengaging gate side 36, thus locking the end side 22 to the gate side 36. When lever 72 is released, the spring 66 will force bolt 64 to the right as illustrated in FIG. 15 of the drawings so that it passes through opening 69 and then through opening 67 of tongue 61. With bolt 64 thus in position, the latch lever 72 will be rotated back into position illustrated in FIG. 13 of the drawings and the bolt 64 likewise will be engaged as illustrated in FIG. 13 of the drawing. This locks the gate side 36 to the end side 22 so that the gate side 36 cannot move in the arrow direction 50 illustrated in FIG. 13 of the drawings without first operating lever 72 to move bolt 64 out of engagement with the plate 58.

Thus, it will be apparent that the locking or latch mechanism 57 provides two functions. First, it locks the end side 22 to the gate side 36 so that force applied to the end side 22 as illustrated in FIG. 15 of the drawings will not permit the end side 22 from moving out of the locking engagement with the gate side 36. Secondly, the latching mechanism 57 prevents the gate side 36 from moving in the arrow direction as illustrated in FIG. 13 and, thereby, preventing disengagement of the gate side 36 from end side 22.

A locking mechanism 57 is provided on each edge of the gate side 36 so that each edge of the gate side 36 is locked to the adjacent edge of the corresponding end sides 22.

An identical locking mechanism 57 is provided for gate side 39. The locking mechanisms 57, catch 47 and all other features described herein to lock gate side 39 into engagement with adjacent end side 22 and 23 are identical to those described in connection with gate side 36. When the gate sides 36 and 39 are engaged with end sides 22 and 23, the container thus assembled will appear as illustrated in FIGS. 1 and 4 of the drawings.

Large shipping containers and storage containers of the type contemplated by this invention present special storage and hauling problems for users. Typically, containers of the type utilized and contemplated by this invention occupy a great deal of storage space since the containers are not collapsible as set forth in this invention. Further, such containers when they are not made collapsible present inconvenience to the shipper and user at times when the container needs to be stored. These problems of disassembly for the purpose of storage or transportation in an empty condition are overcome in the present invention by providing end sides 22 and 23 and gate sides 36 and 39 which are hinged to permit easy collapse of the sides for storage or transportation in an empty condition.

Figure 16:
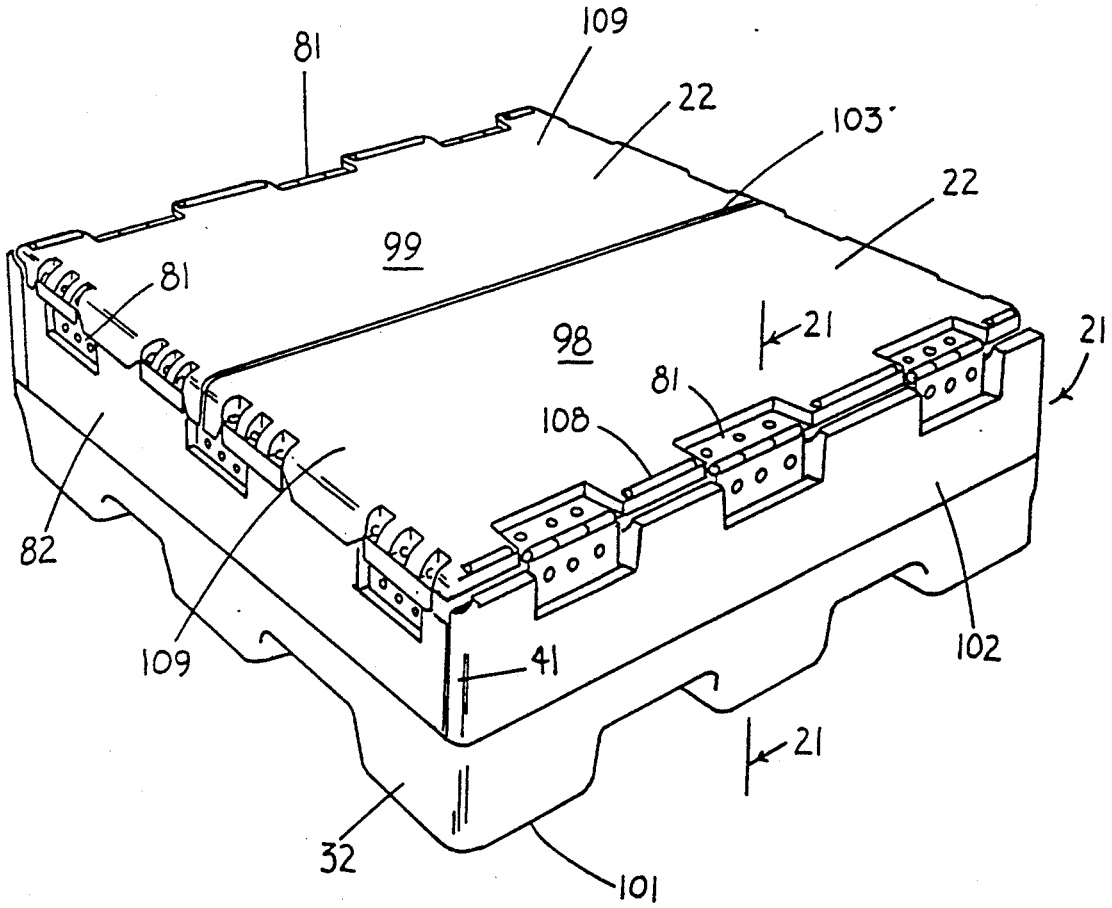
FIG. 16 is a perspective view of a container in accordance with the present invention with the container sides fully folded in a storage or transportation mode.

The container 21, in a collapsed condition for storage or transportation while the container 21 is empty, is illustrated in FIG. 16 of the drawings. In order to collapse the container 21 as illustrated in FIG. 16, the gate wall 36 is provided with a hinged joint 76. Gate side 39 also has an identical hinged joint 77.

In order to collapse the upper section 78 and 79 of gate sides 36 and 39, (FIG. 3) respectively, the latch mechanisms 57 on each of the gate sides are disengaged so that the gate sides 36 and 39 will be disengaged from end sides 22 and 23. This disengaged condition of latched mechanism 57 is illustrated in FIG. 14 of the drawings.

When the latch mechanisms 57 are in the retracted position moving bolt 64 out of engagement with the strike plate 58, the upper portions or sections 78 and 79 of gate sides 36 and 39, respectively, can be pushed inward toward the center of the container 21 so that the upper portion 72 lies upon the platform 26 of base 24. The upper portion 78 of gate side 36 will rotate along hinge joint 76 on hinges 81. Upper portion 78 will rotate about hinge 81 until the upper portion 78 is substantially parallel to the platform or planar support surface 26 of base 24.

Figure 17:
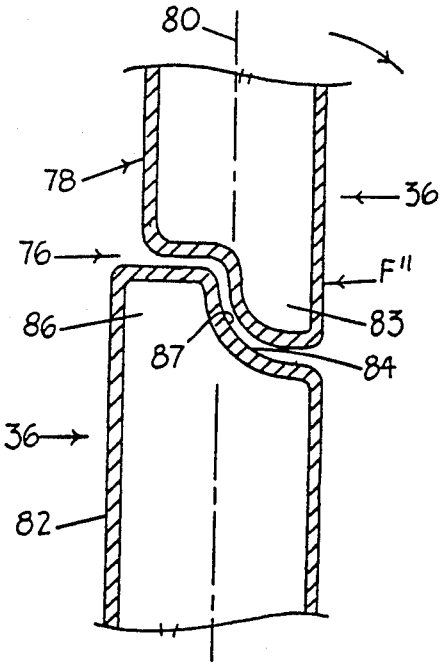
FIG. 17 is a fractional cross-sectional view taken along line 17—17 of FIG. 4 of the drawings illustrating a hinged joint in a side wall of the container.

When upper portion 78 is moved sufficiently to bring it into contact with the planar surface 26 of base 24, the upper portion 78 will have rotated about hinges 81 sufficiently to be at about a 90° degree angle with respect to lower portion 82 of the gate side 36. While joint 76 as well as similar joint 96 may be hinged with a single continuous hinge, the preferred embodiment of the invention uses multiple hinges 81 for reasons which will be apparent hereafter. The function of joint 76 is better illustrated in FIGS. 17 and 18 of the drawings. FIG. 17 illustrates the upper portion 78 and lower portion 82 of gate side 36 vertically aligned along a common longitudinal axis 80 to form a hinged joint 76. This configuration of the joint 76 will occur when the gate side 36 is mounted on base 24 and locked in position with end side 22 and ready to receive material. When in this operational mode, the joint 76 provides a lap joint having a tongue 83 which matches a groove 84 on the lower portion 82. Lower portion 82 has a corresponding tongue 86 which mates with a corresponding groove 87 on upper portion 78 so that a lap joint is constructed and forms the hinge joint 76.

This lap joint construction is especially useful in a container of this type since it provides a reinforcement for the gate side 36. When the container 21 is filled with material, force is applied to the upper portion 78 in the arrow direction as indicated at F''. The force is applied perpendicular to the longitudinal axis 80 of the upper portion 78 of the gate wall 36 so that the tongue 83 is forced against the channel or groove 84 and against tongue 86. Consequently, forces along the arrow direction in Figure will serve to close the hinged joint 76. The greater the force exerted against joint 76, the tighter the joint will become because of the matching characteristics of the tongues 83 and 86. The joint 76 will become stronger because each of the tongues 83 and 86 provide additional material along which forces can be absorbed in the joint 76. This will prevent upper portion 78 and lower portion 82 from being shoved out of alignment with each other by forces applied to the wall of gate side 36 of the container.

Figure 18:
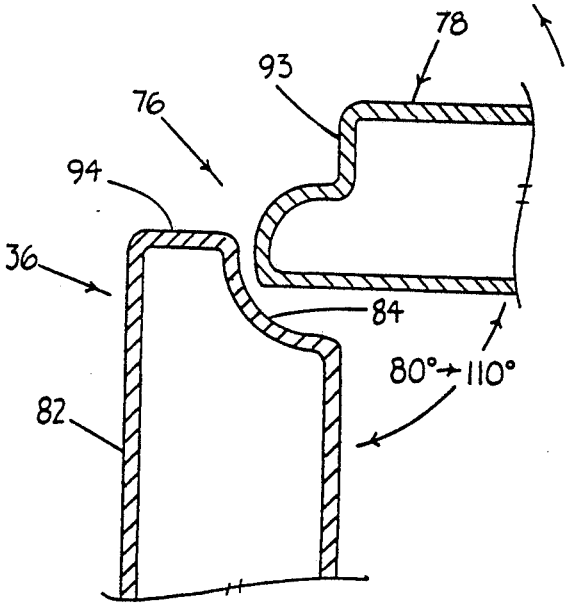
FIG. 18 of the drawings is a fractional cross-sectional view of the joint illustrated in FIG. 17 of the drawings with an upper portion of a container rotated substantially perpendicular to a lower portion of the container side.

When the container 21 must be collapsed for storage or shipment in the empty condition, the upper portion 78 can be rotated to the right as viewed in FIG. 18 of the drawings so that the longitudinal axis of upper portion 78 is substantially perpendicular to the longitudinal axis of the lower portion 82 of the gate wall 36. In drawing FIG. 18 it is noted that the upper portion 78 can form an angle with the lower portion 82 which varies from 90° degrees. The angle of repose of upper portion 78 when it is resting against the planar surface 26 of base 24 can vary from 80° degrees to 110° degrees in the normal situation. This angle formed between the upper portion 78 and the lower portion 82 is not critical and only needs to provide sufficient rotation to permit the upper portion 78 to lie upon the planar surface 26.

Gate side 39 has a hinged joint 77 which functions identically to the hinged joint described in connection with FIGS. 17 and 18. In the case of gate side 39, however, when the upper portion 79 is rotated about hinged axis 77, it may also come to rest against the planar surface 26 or else, it may rest on top of the upper portion 78 of gate side 36. In practice, the container 21 can be collapsed by first lowering either of the upper portions 78 or 79 onto platform 26. The order is of no importance.

Figure 21:
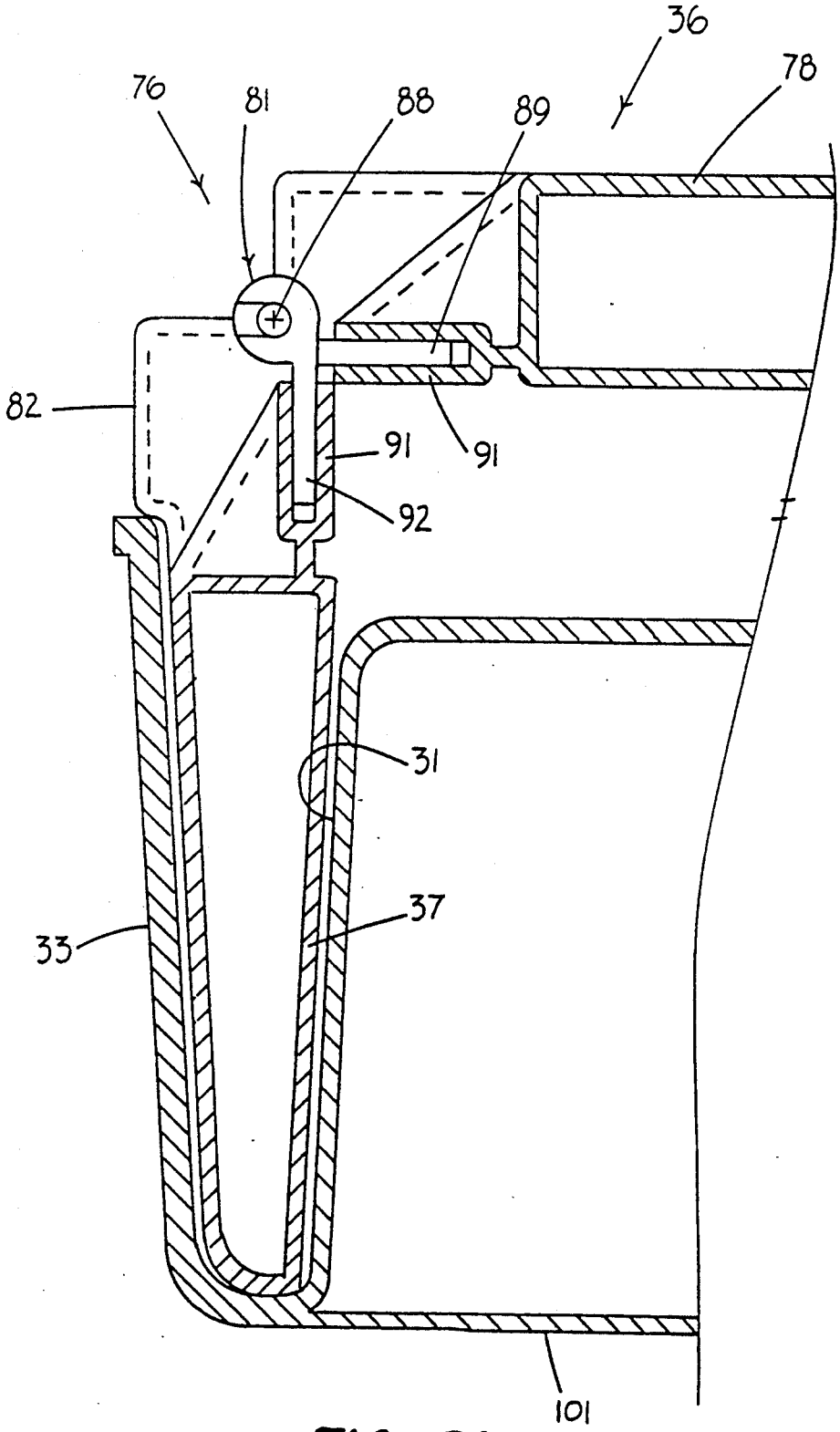
FIG. 21 is a fractional cross-sectional view taken along line 21—21 of FIG. 16 of the drawings.

A more detailed illustration of the hinged joint 76 is illustrated in FIG. 21 of the drawing where the hinged joint 76 is shown in a cross-sectional view taken along line 21—21 of FIG. 4 of the drawings and illustrating a tenon 37 engaging a mortise 31. The tenon 37 engages the mortise 31 to form a mortise joint in foot 33. FIG. 21 illustrates the gate side 36 in the collapsed or hinged condition similar to that of FIG. 18 of the drawings except that the FIG. 21 incorporates a cross-sectional view of the tenon 37 and mortise 31 in foot 33. Hinge 81 rotates about a pin 88. Hinge 81 contains a leg 89 attached to upper portion 78. Leg 89 may be bolted or riveted to plastic molding 91 so that the leg 89 is securely attached to the upper portion 78. Leg 89 may also be permanently molded into the upper portion 78 by commonly known molding techniques.

FIG. 21 also illustrates a useful feature of the tenon 37 and mortise 31 which are both tapered. Tapering insures a tight fit between the tenon 37 and mortise 31 and yet insures that the tenon 37 may be easily removed from mortise 31 when the container 21 is disassembled.

A second leg 92 of hinge 81 is likewise connected to the lower portion 82 by means similar to that used to affix leg 89. The FIGS. 1, 2, 3 and 4 of the drawings illustrate hinge 81 being bolted to the molded portions 91 of the upper portion 78 and lower portion 82, respectively. Other methods might be utilized to attach hinge 81 to the upper and lower portions. The only important criteria is that the hinge 81 be permanently affixed to the upper and lower portions 78 and 82 in order to insure a strong and functional hinged joint 76.

Further, a final feature of the hinged joint 76 is again illustrated in FIGS. 17 and 18 of the drawings in which a bottom surface or support surface 93 of upper portion 78 is adapted to engage a top surface 94 of lower portion 82. When weight is applied to upper portion 78 parallel to the longitudinal axis 80 of the upper portion 78, the upper portion 78 will be forced downwardly as viewed in FIG. 17 of the drawings. When this force condition is applied, as when multiple containers 21 are stacked one upon the other, the support surface 94 acts as a platform for absorbing force applied to the upper portion 78. This platform or support surface 94 permits force to be applied along the entire length of hinged joint 76 to insure uniform distribution of the force along the hinged joint 76 to avoid destruction or damage to the gate side 36. The hinged joint 77 in gate side 39 is constructed in exactly the same fashion as illustrated in connection with hinged joint 76.

Now returning to a description of the method for collapsing the container walls or sides, after the upper portions 78 and 79 are disengaged from end sides 22 and 23 and are folded to rest upon planar surface 26 of base 24, the container is now in a condition to have the end sides 22 and 23 folded on top of upper portions 78 and 79. This folding is accomplished by utilizing hinged seams 96 and 97. See FIGS. 2, 3 and 4 of the drawings. Attention is directed to the fact that hinged joint 96 and 97 are each located at a greater distance from bottom edge 29 of the end side 22 than the corresponding hinged joints 76 and 77 are located from bottom edge 38 of the gate sides 36 and 39. The reason that hinged joint 96 is located farther from the bottom edge 29 is to permit the upper portion 98 and 99 to fold over top of upper portions 78 and 79 and lie freely upon those upper portions 78 and 79 in a plane which is substantially parallel to the support surface 26 of base 24. The hinged joints 96 and 97 are preferably the same distance from the bottom edge 29 of the respective sides 22 in order to form a top surface for the folded container 21 which has top surface substantially parallel to the support surface 26 and to the bottom of the legs 32 and 33. In this configuration, the folded and collapsed container 21 provides a compact package on which other similar containers may be stacked one upon the other for compact storage or shipment in an empty condition.

In a preferred embodiment of the invention, the upper portions 98 and 99 of the sides 22 have no greater dimension than the distance between the lower portion 102 of the side 22 and the center line 103 of the folded container 21 as illustrated in FIG. 16 of the drawings.

It is possible to make the upper portion 98 and 99 sufficiently short in length so that they do not meet at center line 103. In such a configuration, the collapsed and folded container 21 would, nevertheless, provide a substantially horizontal and flat surface at the top of the folded container 21. Overlapping the upper portions 98 and 99 would not produce a flat surface and, therefore, is to be avoided in the construction of the end sides 22 and 23. This configuration is achieved by locating hinged joints 96 and 97 sufficiently above hinged joints 76 and 77 so that the container may be collapsed to form an extremely compact and uniform configuration. FIG. 4 illustrates the construction of the hinged joints 96 and 76 on adjacent sides of the container so that the flat upper surface can be achieved which is illustrated in FIG. 16 of the drawings.

Figure 19:
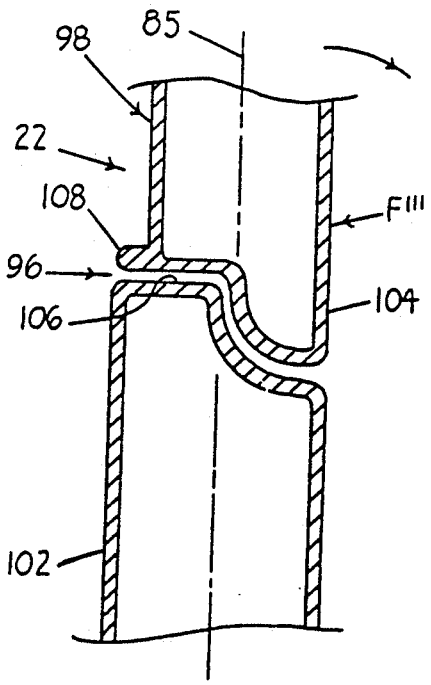
FIG. 19 is a fractional cross-sectional view taken along line 19—19 of FIG. 4 of the drawings illustrating a hinged joint in a side wall of a container in accordance with the present invention.
Figure 20:
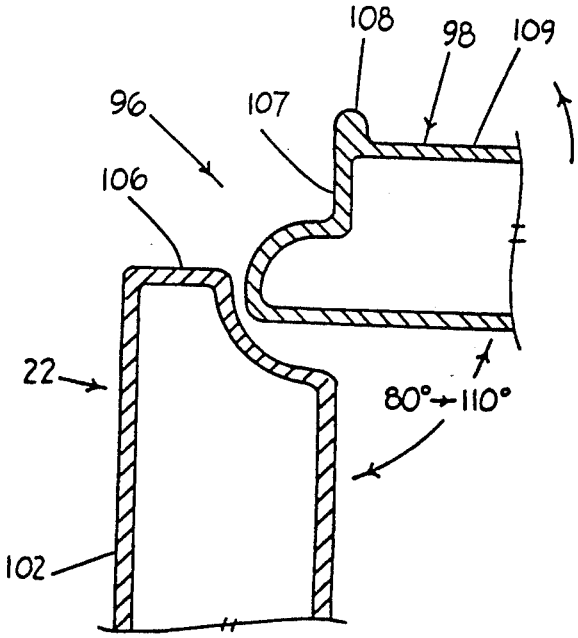
FIG. 20 is a cross-sectional fractional view as illustrated in FIG. 19 of the drawings with an upper portion of the side rotated substantially perpendicular to a lower portion of the container end side.

Refer next to FIGS. 19 and 20 of the drawings in which the specific configuration of hinged joint 96 is illustrated. FIG. 19 is a fractional cross-sectional view taken along line 19—19 of FIG. 4 of the drawings and illustrates the upper portion 98 and lower portion 102 of end side 22 in vertical alignment with each other so that the longitudinal axes 85 lie parallel to each other. Hinged joint 96 works virtually identical to hinged joint 76 previously described. Hinged joint 96 contains a tongue 104 which forms an extension of upper portion 98 which engages a tongue 106 forming a portion of lower portion 102. Tongue 104 engages Tongue 106 when forces illustrated by the arrow F''' are applied to the upper portion 98 of end wall 22. Tongue 104 will tightly engage tongue or support surface 106 and form a strong bond with tongue 106 as greater force is applied to tongue 104. As with the joint 76, a support surface 106 is provided for supporting a bottom surface or support surface 107 so that as weight is applied parallel to the longitudinal axis 85 of upper portion 98, the bottom surface 107 will engage support surface 106 to distribute force along the entire length of hinged joint 96 thus insuring that the end side 22 will not collapse or be damaged as greater weight is applied to the top surface of end side 22 as when multiple containers are stacked in open condition.

In all respects, joint 96 operates the same as joint 76 as previously described and, accordingly, further description of the function of the joint is deemed unnecessary at this point except to describe one feature employed in joint 96 and in joint 97 which are not common to joint 76. This feature is projection 108. Projection 108 is utilized to provide an irregular surface so that when the container 21 is in the collapsed condition, the projection 108 extends above the upper surface 109 of the upper portion 98. This projection 108 acts as a catch to engage parts of a container stacked upon the collapsed container 21 so that the stacked containers will not slide about upon each other but will be securely engaged surface to surface with other containers which are stacked above the surface 109.

A final and important feature of the invention involves a gate 111 which may be built into either one or both of the gate sides 36 and 39, respectively. The drawings, FIGS. 1, 3 and 4 illustrate gates 111 mounted in both the gate sides 36 and 39. However, it is possible to construct a preferred embodiment of this invention where a gate 111 is only built into a single gate side 36. Consequently, the operation and function of gate 111 will be described only in connection with gate side 36. It is to be understood, however, that an alternate embodiment of this invention would employ two identical gate sides 36, one of which has been designated as gate side 39 for the purpose of illustrating this invention.

Gate 111 is hinged to gate side 36 by hinges 8 which functions exactly the same as hinge 81 described in connection with FIG. 21 of the drawings. Accordingly, no further description is deemed necessary in connection with the operation of hinges 81.

Likewise, gate 111 is latched to gate side 36 by a latch mechanism 57 which functions identically to that described in connection with FIGS. 13, 14 and 15. Consequently, further description of the latching mechanism 57 is not deemed necessary. FIG. 3 of the drawings illustrates gate 111 in the closed position. In this position, gate 111 forms a uniform wall in upper portion 78 of gate side 36 so that container 21 can be used for storage of materials of all types. Gate 111 in the configuration illustrated in FIG. 3 of the drawings is locked into position by latch mechanisms 57 which function as previously described.

Reference to FIG. 4 of the drawings will illustrate, however, that gate 111 is hinged to pivot outwardly away from the center of the container 21 so that gate 111 folds down along an outside surface of gate side 36 to permit easy access to the contents of the container 21. Gate 111 is hinged so that the gate 111 will lie along an outside surface of portion 78 and so that the gate 111 has a planar surface parallel to the outside surface of upper portion 78.

Figure 22:
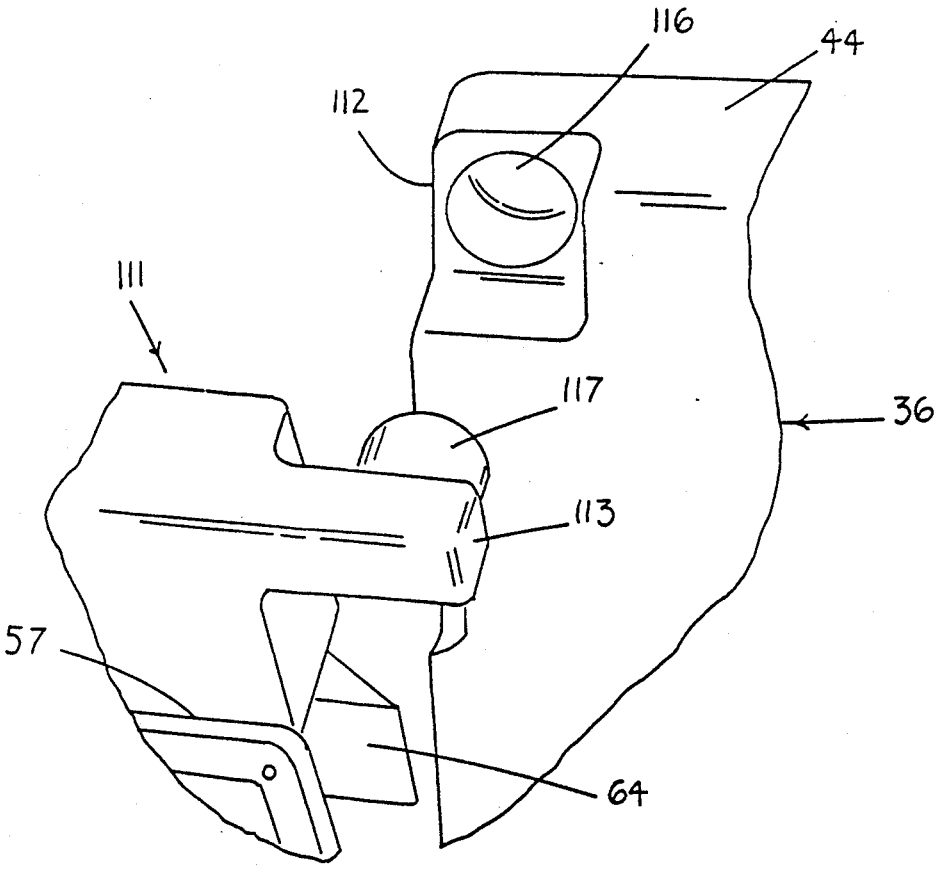
FIG. 22 is a fractional perspective view of a boss and cavity restraining mechanism utilized on an access gate illustrated in FIG. 4 of the drawings.
Figure 23:
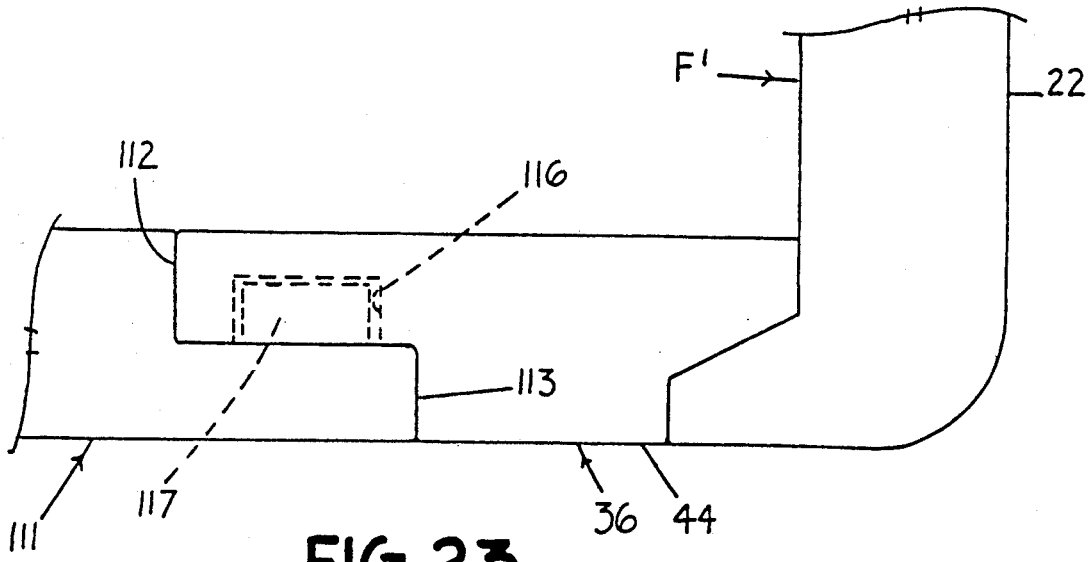
FIG. 23 of the drawings is a fractional top view of a corner of a container illustrated in FIG. 1 and the boss and cavity restraining mechanism illustrated in FIG. 22 of the drawings.

During the construction of gate side 36, it was discovered that as material is loaded into the container 21, the loaded material exerted forces against the walls of the sides 22, 23, 36 and 39 of sufficient force that the sides of the container 21 tended to disengage. Previous descriptions in connection with restraining members and latches has illustrated the methods by which the inventors have overcome these internal forces in order to prevent the sides of the container from disengaging. These forces also tended to distort the upper portion 78 of gate side 36 so that the bolts 64 of locking mechanisms 57 tended to disengage from the support sides 44 of upper portions 78. Consequently, some mechanism was necessary in order to prevent the inside edge 112 of support side 44 from being pulled out of engagement with edge 113 of gate 111. FIGS. 22 and 23 of the drawings are fractional views illustrating the locking connection employed to prevent edges 112 and 113 from being pulled apart as force is applied to end side 22. In order to insure that edges 112 and 113 are not pulled apart, when a force F' is applied to end side 22, an arrangement is employed which utilizes a cavity 116 and an engaging boss 117. Boss 117 is positioned within cavity 116 when gate 111 is closed so that the force F' applied on end side 22 will not force surfaces 112 and 113 apart.

FIG. 22 of the drawings illustrates the gate 111 disengaged from the support side 44. This disengaged gate 111 is also illustrated in FIG. 4 of the drawings where gate 111 is shown in a partially opened condition. The gate 111 is closed by moving the gate 111 in the arrow direction as illustrated in FIG. 22 of the drawings so that boss 117 fits within cavity 116. When this occurs, the bolt 64 of latch mechanism 57 locks the gate 111 into the support side 44 of gate side 36 so that the gate 111 will no longer open without being unbolted. The boss 117 thus engages cavity 116 and prevents surfaces 113 and 112 from being pulled apart when the container is filled.

Gate 111 is provided with a boss and cavity locking connection on each side of the gate 111 as illustrated in FIG. 4 of the drawings. Thus, it will be apparent that forces applied to the inside surface of the sides of the container 21 will not destroy the integrity of the container. These forces are counteracted by the latching mechanisms 57, the particular construction of joint seams 76 and 96, the use of a boss and cavity arrangement on gate 111, the use of passive restraint mechanisms and the use of a lap joint at the adjoining corners of the gate and end sides respectively. This cooperation of locking and restraining mechanisms provide a hinged collapsible container which provides unusual rigidity in use and yet permits the user to collapse the container in a variety of ways in order to insure compactness when storage of the container or shipment of the container is desired. The particular configuration permits efficient use of warehouse space when the container is in a collapsed and stored condition and yet the various restraint and locking mechanisms provide a highly efficient and strong container for storage and transportation of materials ranging from liquids to large mechanical parts.

Liquids may by shipped in the preferred embodiment of the invention by simply providing a waterproof or liquid-proof lining for the container 21. Where small parts such as bolts, washers or similar mechanical devices are employed, no such lining is necessary. The container, however, provides sufficient strength due to the employment of a mortise joint connecting the side walls ends to the base to permit the container to withstand extremely heavy loads not only against the base 24 of the container but also against the side walls of the container.

Due to the specific configuration of the base, lift fork teeth may be inserted in the openings 114 so that the forklifts may engage the base 24 to lift the loaded container or to stack the loaded container as desired. The openings 114 ar provided between the feet 32 and 33 on all sides of the base 24 to provide convenient access to the container 21 for lifting from all four sides of the container 21.

The above-described specific embodiment of the invention is set forth for illustrative purposes. Many variations in the described configurations are possible without departing from the spirit and scope of the invention. For instance, the ends and side walls of the container may be constructed of a variety of different plastics or metal materials. Further, the hinges may be constructed of metal or plastic depending upon the particular needs of the container. The specific shape of the tenons 28 and mortise 31 are not critical. The mortise joint can be formed employing a variety of shapes of tenons 28 and mortises 31 which will be satisfactory for the functioning of the base 24.

These and other variations are within the spirit and scope of the invention which are set forth in the following claims.

I claim:

1. A collapsible container which comprises:

A. A base having a generally planar support surface;

B. A plurality of legs mounted about the periphery of said support surface and extending from said surface downwardly and perpendicular to said support surface;

C. Said legs having mortises extending into said legs and from the periphery of said support surface and perpendicular to said support surface;

D. A first pair of sides having tenons extending from a bottom edge of each of said first pair of sides and for engaging the mortises in said legs to form a mortise joint to position each of said pairs of first sides in an upright position perpendicular to said support surface on opposite sides of said base and each of said sides having upright edges perpendicular to said support surface;

E. Each of said first pair of sides having a hinged joint extending between said upright edges and parallel to said bottom edge of said first side to divide each of said first pairs of sides into an upper portion and a lower portion;

F. A second pair of sides having tenons extending from a bottom edge of each of said second pairs of sides and for engaging the mortises in said legs to form a mortise joint to position each of said pairs of second side in an upright position perpendicular to said support surface on opposite sides of said base having upright edges in edge to edge contact with the upright edges of said first sides;

G. Each of said second pair of sides having a hinged joint extending between said upright edges of said second sides and parallel to said bottom edge of said second sides to divide each of said second pair of sides into an upper portion and a lower portion;

H. Said upright edges of said first and second sides forming a lap joint connection; and I. Lock means interconnecting said first and second pairs of sides at the edge to edge contact of upright edges on adjoining first and second sides.

2. A collapsible container in accordance with claim which said legs are positioned about the periphery of said base to provide openings between the legs to accommodate a fork lift to lift the container.

3. A collapsible container in accordance with claim 1 in which each mortise and tenon is tapered to insure locking engagement between the tenon and the mortise and to ease removal of each tenon from the engaged mortise to permit rapid assembly and disassembly of the first and second pairs of sides in said base.

4. A collapsible container in accordance with claim 1 in which said lock means is located in said upper portion of each of the said first and second pairs of sides.

5. A collapsible container in accordance with claim 1 in which at least one of said first pairs of sides being a gate side which includes a gate forming a portion of said gate side, a gate hinge means interconnecting a hinged edge of said gate and said gate side with the gate hinge means forming a hinge line parallel to said bottom edge between a first edge of said gate and said gate side, latch means interconnecting said gate and said gate side to align said gate with said gate side to from a uniform wall, restraint means mounted on said gate side, engaging means mounted on said gate and adapted to engage said restraint means to prevent said latch from disengaging when force is applied to said gate side parallel to said gate hinge.

6. A collapsible container in accordance with claim 5 in which said restraint means includes a side extension mounted on said gate side, said side extension having a cavity, said engaging means including a gate projection having a boss for engaging said cavity to prevent said gate side from moving away from said gate when force is applied to said gate side parallel to said gate hinge.

7. A collapsible container in accordance with claim 5 in which both of the sides of said first pair of sides include a gate, a gate hinge means, latch means, restraint means and engaging means as set forth in claim 5.

8. A collapsible container in accordance with claim 5 in which said gate hinge means is mounted to permit said gate to rotate about said hinge line outwardly from the center of said planar support surface.

9. A collapsible container in accordance with claim 1 in which a plurality of individual hinges connect the upper and lower portions of each of said first pairs of sides to form said hinged joint in each of said first pair of sides and in which a plurality of individual hinges connect the upper and lower portions of each of said second pairs of sides to form said hinged joint in each of said second pair of sides.

10. A collapsible container in accordance with claim 9 in which said upper and lower portions of each of the said hinged joints in each of the sides of said first and second pairs of sides contain upper and lower support surfaces, said upper and lower support surfaces being in contact to transmit force applied to the upper portion to the lower portions.

11. A container in accordance with claim 10 in which said hinged joints are formed by a lip and tongue engagement between the upper and lower portions of each of the sides of said first and second pairs of sides.

12. A collapsible container in accordance with claim 1 in which said lap joint is formed with a lip extending along substantially the entire length of the upright edges of each of said second pair of sides and a tongue extending along substantially the entire length of the upright edges of each of said first pairs of sides for engaging said lips to form a lap joint.

13. A collapsible container in accordance with claim 12 in which the lips and tongues of said joint are engaged to prevent the upper portion of said first pair of sides from rotating about said hinged joint outwardly from said base while permitting said upper portion of said first pair of sides to rotate about said hinged joint inwardly toward the planar support surface of said base.

14. A collapsible container in accordance with claim 1 in which the bottom edge of each of said first and second pairs of sides lie in a common plane parallel to the planar surface of said base when the said first and second pairs of sides are mounted on said base and in which the hinged joint in said second pair of sides is positioned farther above said plane than the hinged joint in said first pair of sides to permit said first pair of sides to be folded inwardly upon said planar surface and to permit said second pairs of sides to be folded inwardly on top of said first pair of sides to collapse said container into a compact unit.

15. A collapsible container in accordance with claim 14 in which the upper portion of said second pair of sides is less than half the distance from the center of the planar support surface of said base to the periphery of said support surface.

16. A collapsible container in accordance with claim 1 which further includes a retainer means interconnecting the lower portions of each side of said first and second pairs at the lap joint connection.

17. A collapsible container in accordance with claim 16 in which said retainer means includes a catch mounted on the lower portion of said second pair of sides on each edge of said lower portion, and a stop mounted on the lower portion of each edge of each of the said first pair of sides to engage said catch.

18. A container in accordance with claim 1 in which said lock means includes a strike plate mounted on each upright edge of each of the sides of said second pair of sides, a lock stop mounted on each upright edge of each side of said first pair of sides for engaging said first pair of sides for engaging said catch and a latch for interconnecting said catch and lock stop to interconnect the edges of the sides of said first and second pairs of sides.

* * * * *